US009415966B2

(12) United States Patent
Nishi et al.

(10) Patent No.: US 9,415,966 B2
(45) Date of Patent: Aug. 16, 2016

(54) POST-PROCESSING APPARATUS, AND IMAGE FORMATION APPARATUS

(71) Applicants: Yuki Nishi, Yamanashi-ken (JP); Natsuki Shimizu, Yamanashi-ken (JP)

(72) Inventors: Yuki Nishi, Yamanashi-ken (JP); Natsuki Shimizu, Yamanashi-ken (JP)

(73) Assignees: CANON FINETECH INC., Misato-Shi, Saitama-Ken (JP); NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/582,673

(22) Filed: Dec. 24, 2014

(65) Prior Publication Data

US 2015/0183606 A1 Jul. 2, 2015

(30) Foreign Application Priority Data

Dec. 27, 2013 (JP) ..... 2013-271340

(51) Int. Cl.

*B65H 31/34* (2006.01)
*B65H 31/02* (2006.01)
*B65H 31/30* (2006.01)

(52) U.S. Cl.

CPC ..... *B65H 31/34* (2013.01); *B65H 31/02* (2013.01); *B65H 31/3063* (2013.01); *B65H 2301/4212* (2013.01); *B65H 2301/4213* (2013.01); *B65H 2402/543* (2013.01); *B65H 2403/41* (2013.01); *B65H 2511/12* (2013.01); *B65H 2511/20* (2013.01); *B65H 2513/10* (2013.01); *B65H 2513/53* (2013.01); *B65H 2555/26* (2013.01); *B65H 2557/242* (2013.01); *B65H 2701/1313* (2013.01); *B65H 2801/27* (2013.01)

(58) Field of Classification Search

CPC ..... B65H 29/70; B65H 31/26; B65H 31/34; B65H 33/06; B65H 33/08; B65H 2301/162; B65H 2301/4219; B65H 2301/42244; B65H 2301/51214; B65H 2404/741; B65H 2404/743; B65H 2408/114

USPC ..... 271/209, 220; 414/791.2

See application file for complete search history.

(56) References Cited

U.S. PATENT DOCUMENTS

| | | | | |
|---|---|---|---|---|
| 6,231,039 | B1 * | 5/2001 | Chung | 270/58.01 |
| 6,293,543 | B1 | 9/2001 | Lawrence | |
| 2013/0341854 | A1 * | 12/2013 | Miyakawa et al. | 271/145 |

FOREIGN PATENT DOCUMENTS

| | | | |
|---|---|---|---|
| JP | H11-147654 | A | 6/1999 |
| JP | 2003-002519 | A | 1/2003 |
| JP | 2004-066662 | A | 3/2004 |

OTHER PUBLICATIONS

Europe Patent Office, "Search Report for European Patent Application No. 14200333.4," Feb. 16, 2016.

* cited by examiner

*Primary Examiner* — David H Bollinger
(74) *Attorney, Agent, or Firm* — Manabu Kanesaka

(57) ABSTRACT

A post-processing apparatus includes a sheet support device, a pair of side edge regulation members that engage in sheet opposite side edges on the sheet support device, and a shift device configured to shift a position of each of the side edge regulation members, and thereby causing the members to perform carry operation to shift the sheet on the sheet support device, wherein in executing the carry operation, the shift device sandwiches the sheet by the pair of side edge regulation members, and thereby makes a state in which pressure is applied to the sheet to execute.

10 Claims, 8 Drawing Sheets

POST-PROCESSING APPARATUS, AND IMAGE FORMATION APPARATUS

RELATED APPLICATIONS

The present application is based on, and claims priority from, Japanese Application No. 2013-271340 filed Dec. 27, 2013, the disclosure of which is hereby incorporated by reference herein in its entirety.

BACKGROUND OF THE INVENTION

The present invention relates to a post-processing apparatus for performing post-processing on an image-formed sheet, and more particularly, to improvements in a sheet alignment mechanism for aligning and collecting sheets in a post-processing section, and then shifting the position to a post-processing position.

Generally, this kind of post-processing apparatus is known as an apparatus which is connected to a sheet discharge outlet of an image formation apparatus, performs post-processing on an image-formed sheet on a processing tray, and then stores in a stack tray. Then, as the post-processing is known bookbinding processing for collating and collecting sheets to perform binding processing, punching processing for punching a file hole in a sheet, folding processing for folding a sheet and the like.

For example, Patent Document 1 discloses an apparatus which is incorporated into a sheet discharge outlet of an image formation apparatus as a device, stacking image-formed sheets on a processing tray to collect while aligning the position, and shifts the position of a bunch of collected sheets.

The Document proposes a mechanism in which a pair of right and left alignment plates (members) are disposed to be able to shift to positions in the sheet width direction, and concurrently with alignment operation by both of the alignment plates, a bunch of sheets is transported from an alignment position to a processing position. Then, the alignment operation is to correct the posture of a sheet to load by shifting the right and left alignment plates in approach directions and to carry a bunch of sheets.

PRIOR ART DOCUMENT

Patent Document

[Patent Document 1] Japanese Patent Application Publication No. H11-147654

DISCLOSURE OF INVENTION

Problems to be Solved by the Invention

As described above, such an apparatus has already been known that temporarily supports sheets fed from the image formation apparatus or the like in the post-processing section to perform post-processing. Then, Patent Document 1 and the like propose the apparatus which aligns a sheet in a predetermined reference position in the post-processing section (processing tray or the like) to collect in a stacked shape and which offsets and shifts a bunch of collected sheets from the alignment position to the processing position.

Patent Document 1 proposes the mechanism in which a pair of right and left alignment plates (alignment members) are caused to reciprocate to approach and separate in the sheet width direction to align a sheet, and the position of a bunch of collected sheets is shifted from the alignment position to the processing position using the alignment plates.

However, the following problem arises in such a method of aligning and carrying a bunch of sheet. Since a bunch of sheets is shifted while sliding along the load surface, balance of forces added to the sheet side edges from the right and left alignment plates is impaired, and a bunch of sheets is inclined.

It is an object of the present invention to provide a post-processing apparatus that enables a sheet to be carried in an accurate state in shifting a position of the sheet to a predetermined position after aligning in a post-processing section.

Means for Solving the Problem

To attain the above-mentioned object, the present invention is characterized by arranging a pair of side edge regulation members that engage in sheet opposite side edges in a support surface to place a sheet, and providing a shift device for causing the regulation members to perform alignment operation for aligning a sheet in a predetermined reference position and carry operation for shifting the sheet to a predetermined position, and a controller thereof, where in executing the carry operation, the controller controls the shift device so as to change a distance between the side edge regulation members to be narrower than a distance in the alignment operation, and after shifting a position of a bunch of sheets, return to a wide distance from a narrow distance before finishing the shift.

The configuration will be described more specifically. The apparatus is provided with a sheet support device for placing a sheet, a pair of side edge regulation members that engage in sheet opposite side edges on the support surface, and a shift device for shifting a position of each of the side edge regulation members, and thereby causing the members to perform carry operation for shifting the sheet on the sheet support device.

In executing the carry operation, the shift device sandwiches the sheet by the pair of side edge regulation members, and thereby makes a state in which pressure is applied to the sheet to execute. Further, the apparatus is provided with a controller for controlling the shift device, and thereby changing a distance between the pair of side edge regulation members.

Advantageous Effect of the Invention

The present invention is to set a distance between a pair of right and left side edge regulation members disposed in the sheet support surface to be narrower than a distance in alignment in shifting the position to a different position after aligning a sheet, and after shifting the position, return to a wide distance from a narrow distance before finishing the shift, and therefore, exhibits the following effects.

In shifting a position of a single sheet or bunch-shaped sheets from an alignment position on the support surface to a different position (for example, post-processing position), since a pair of side edge regulation members are set for a distance narrower than the alignment distance, the sheet shifts from the alignment position toward the processing position in a state (posture) in which the sheet is curved and deformed in the shape of a U or in the shape of an inversed U. At this point, the sheet (bunch) is nipped at the front and back in the travel direction by the side edge regulation members and is curved and deformed.

In other words, the sheet (bunch) is sandwiched by a pair of right and left side edge regulation members, and is in a state in which pressure is applied to the sheet by the pair of right and left side edge regulation members. Accordingly, the contact area between the sheet and the support surface is significantly reduced as compared with the alignment state, and therefore, friction resistance by the shift and generated static electricity is also reduced.

Concurrently therewith, in the sheet curved in the shape of a U or in the shape of an inversed U, the entire sheet is carried in a strengthened state rich in rigidity by curving even when the size is large or the regulation members are disposed to engage in the sheet side edges in a partially leaning position, and therefore, disturbance of the posture and skew is reduced.

Further, in shifting from the alignment position to the predetermined shift position, the sheet is returned to the wide distance from the narrow distance before finishing the shift, and therefore, is returned to a flat state from a curved state. Accordingly, the sheet is fed to the predetermined shift position (processing position or the like) in a flat normal posture. Therefore, even when a post-processing apparatus such as a binding processing device is disposed in the processing position, any problem does not occur such that the sheet side edge strikes and is bent.

BRIEF DESCRIPTION OF DRAWINGS

FIG. 4A shows a state in which sheets are aligned in an alignment position, FIG. 4B shows a state in which the sheets are curved and deformed, FIG. 4C shows a state in which the sheets are being shifted, FIG. 4D shows a state immediately before finishing a position shift of the sheets, and FIG. 4E shows a state in which the sheets are stopped in the processing position;

FIG. 5A shows Embodiment 1, FIG. 5B shows Embodiment 2, and FIG. 5C shows Embodiment 3;

FIG. 6A shows a configuration of a front regulation member, FIG. 6B shows an alignment operation state, FIG. 6C shows a carry operation state, and FIG. 6D is a configuration view of a rear regulation member;

DETAILED DESCRIPTION OF PREFERRED EMBODIMENTS

Figure 1:
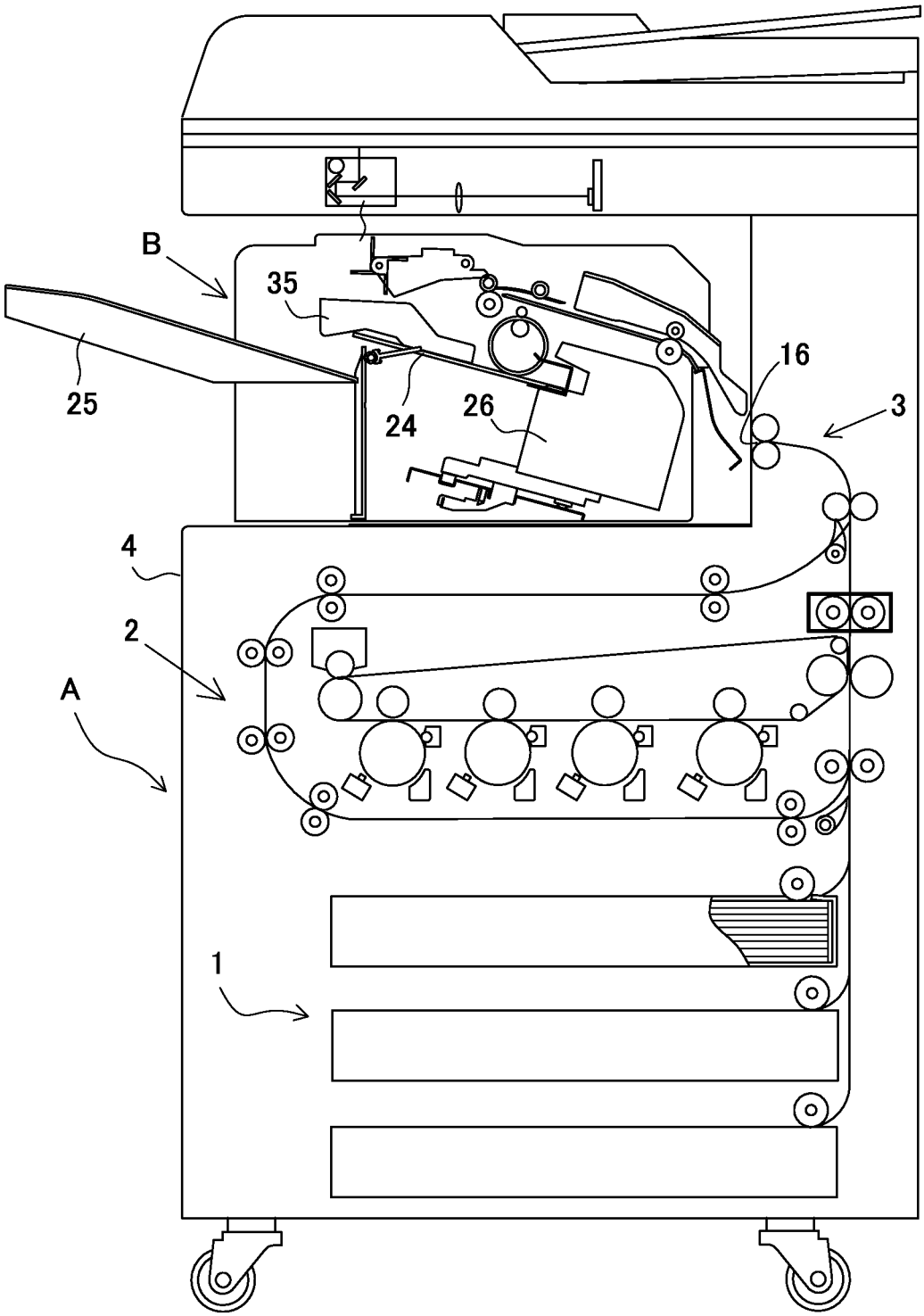
FIG. 1 is an explanatory view of an entire configuration of an image formation apparatus according to the present invention.

The present invention will specifically be described below based on to preferred Embodiments shown in drawings. FIG. 1 is an explanatory view illustrating an entire configuration of an image formation apparatus according to the invention. The configuration is comprised of an image formation apparatus A that forms an image on a sheet, and a post-processing apparatus B that performs post-processing on the image-formed sheet. Moreover, the image formation apparatus is capable of being coupled to a network terminal such as an outside computer apparatus or the like to construct an image formation system.

[Image Formation Apparatus]

The image formation apparatus A is comprised of a paper feed section 1 that stores sheets to form an image, an image formation section 2 that forms an image on a sheet fed from the paper feed section, and a sheet discharge section 3 that carries out the image-formed sheet from a sheet discharge outlet 16. The image formation section 2 is comprised of an electrostatic printing mechanism, inkjet printing mechanism, offset printing mechanism or the like. Further, the image formation apparatus A is in the case of constructing a system as a terminal of a network system, or is configured as a single-function apparatus (standalone) such as a copier and facsimile apparatus.

[Post-Processing Apparatus]

The post-processing apparatus B carries a sheet carried out of the image formation apparatus A in a sheet support device 24 (processing tray as described later) disposed on the downstream side from a transport path 22 to temporarily store. Then, the apparatus performs post-processing on the sheet positioned in a predetermined position on the sheet support device, and then stores in a stack tray 25 on the downstream side.

Figure 2:
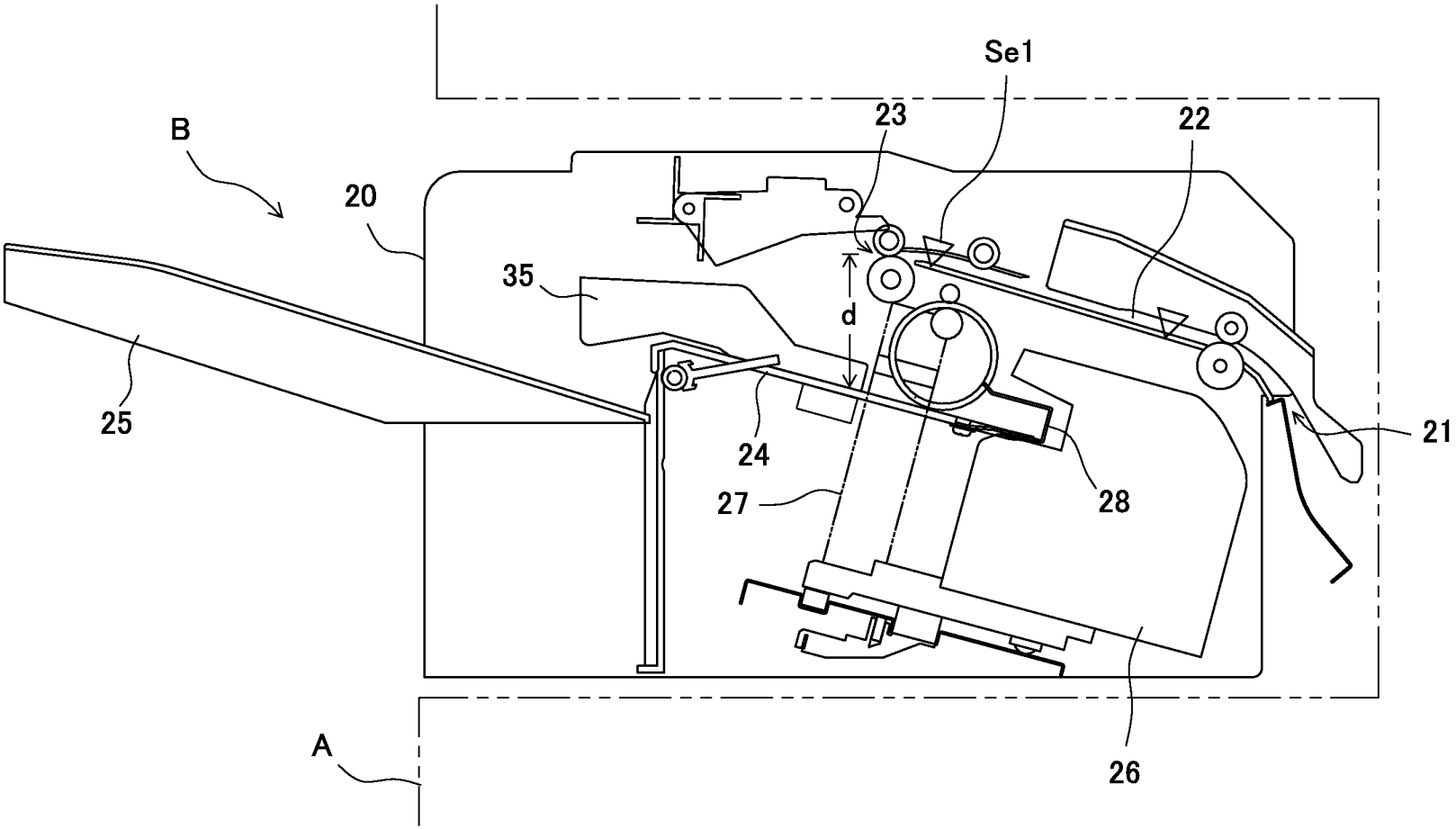
FIG. 2 is an explanatory view of a transport mechanism of a sheet to a post-processing section in the apparatus of FIG. 1.
Figure 3:
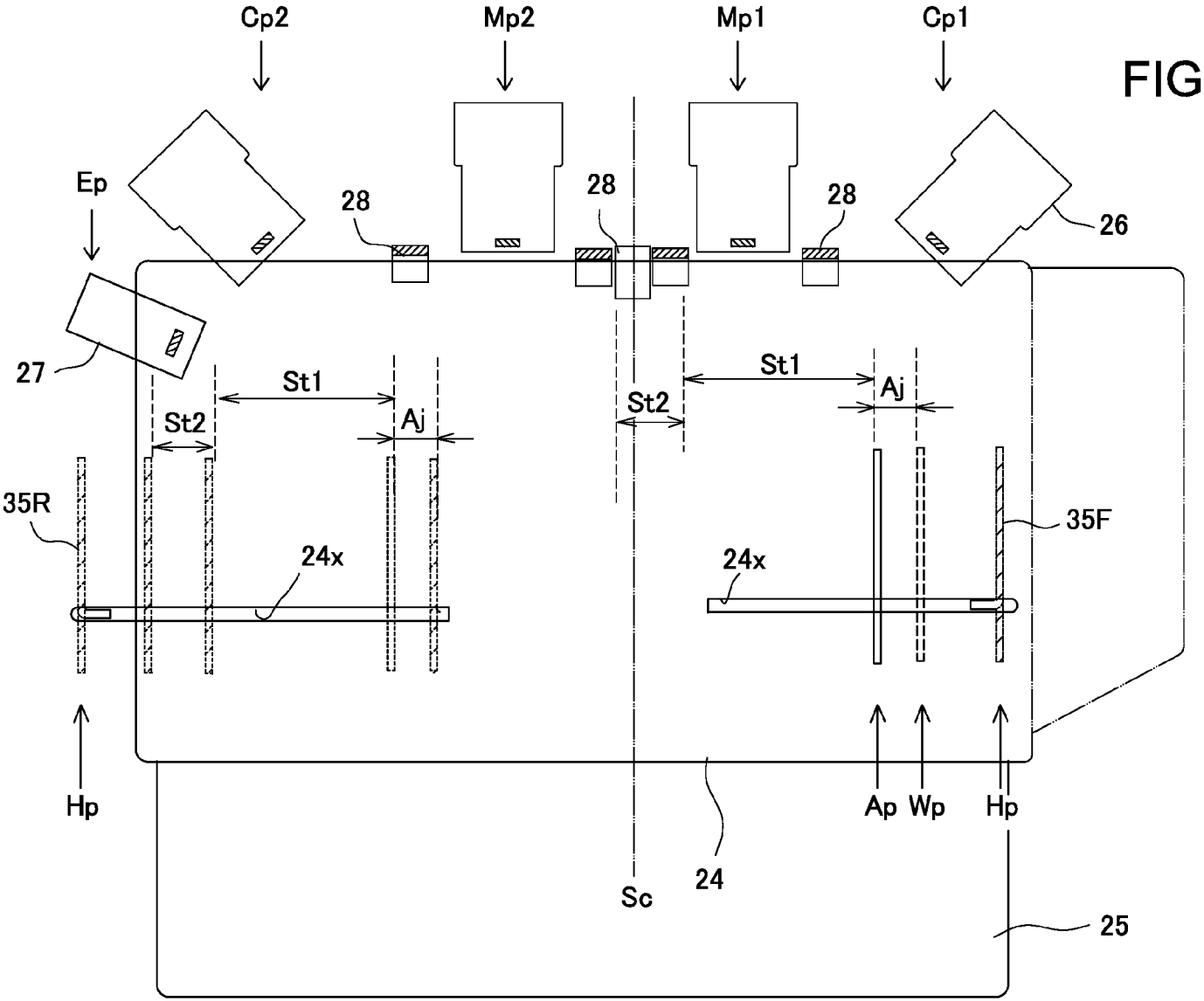
FIG. 3 is an explanatory view of a mechanism for carrying a sheet from sheet alignment in a sheet support device (processing tray) to a processing position in the apparatus of FIG. 1.

FIG. 2 shows a cross-sectional configuration of the post-processing apparatus B, and FIG. 3 shows a plan configuration of the apparatus B. The transport path 22 is comprised of a liner path disposed in the horizontal direction in an apparatus housing 20 so as to transport a sheet from a carry-in entrance 21 coupled to the sheet discharge outlet 16 (main body sheet discharge outlet) of the image formation apparatus A (image formation section) to a sheet discharge outlet 23. On the downstream side of the sheet discharge outlet 23, a processing tray 24 (sheet support device) is disposed below while forming a level difference d.

The stack tray 25 is comprised of a load tray disposed below on the downstream side of the processing tray 24 while forming a level difference to store a sheet (single sheet or sheet bunch) subjected to post-processing. As shown in FIG. 2, in the processing tray 24, the transport path 22 is disposed above the tray 24, the stack tray 25 is disposed below the tray 24, and the sheet is transported in the order of the processing tray 24, and next stack tray 25 from the transport path 22.

The processing tray 24 is comprised of a tray member having a support surface 24*a* to load and support a sheet, and is configured so that the support surface 24*a* shown in the figure supports the sheet rear end portion, and that the sheet front end portion is supported on the uppermost sheet loaded on the stack tray 25. The processing tray 24 is provided with a post-processing device 26 (27) that performs post-processing on the sheet (single sheet or sheet bunch; the same in the following description), and an alignment mechanism 30 for positioning the sheet in a post-processing position.

[Post-Processing Device]

As a post-processing device that performs post-processing on the sheet temporarily supported on the processing tray, in the apparatus shown in the figure are disposed a first binding processing device 26 and second binding processing device 27 that perform binding processing on a bunch of sheets. As shown in FIG. 3, the first binding processing device 26 is comprised of a stapler apparatus, and selectively executes "multi-binding processing" for performing binding processing on a plurality of portions of a bunch of sheets loaded on the support surface of the processing tray 24, and "corner binding processing" for performing binding processing on a sheet corner. Mp1 and Mp2 shown in the figure denote multi-binding positions, Cp1 and Cp2 denote corner binding positions, and the stapler apparatus 26 is attached to an apparatus frame to be able to shift to positions as shown in the figure.

The second binding processing device 27 is comprised of a press binder apparatus that binds sheets without using staples (metal fittings), and binds a bunch of a plurality of sheets by nipping the bunch of sheets with a pair of up and down pressing surfaces in a concavo-convex shape. Ep shown in the figure denotes the binding position.

In addition, in the present invention, as the post-processing device, as well as the binding processing device 26 (27), it is possible to adopt a punch device that punches a file hole in a sheet, a stamp device that puts a seal on a sheet, a folding processing device that performs folding processing on a sheet and the like.

[Alignment Mechanism]

In the processing tray 24 are disposed the following sheet end regulation stopper 28 and side edge regulation members 35 so as to position a sheet, which is carried in from the transport path 22, in a reference position on the support surface.

[Sheet end Regulation Stopper]

The sheet end regulation stopper 28 is disposed on the front side of the processing tray 24 in the sheet carry-in direction, and strikes and regulates the end edge of the sheet that is carried in. In the stopper shown in the figure, in relation to the fact that the sheet is carried in the processing tray 24 from the transport path 22 while reversing the transport direction, stopper members are disposed on the processing tray so that the sheet rear end edge strikes the regulation stopper 28. As shown in FIG. 3, the regulation stopper 28 is comprised of locking hooks spaced a distance to strike and regulate the rear end edge of the sheet.

[Side Edge Regulation Member]

In the processing tray 24 are disposed the side edge regulation members 35 that align opposite side edges of the sheet, which is regulated in the rear end edge by the sheet end regulation stopper 28, in a beforehand set reference. As the set reference are known a center reference to coincide the sheet center of a different paper size, and a side reference to coincide one side edge of the sheet. The present invention allows both references, and described is the case of aligning the sheet on the processing tray in the center reference.

As shown in FIG. 3, a pair of right and left side edge regulation members 35 are disposed so as to support opposite side edges of the sheet on the processing tray, and each of the members is provided with an engagement surface 35*x* to engage in the sheet side edge. In the following description, for convenience in description, the member positioned on the right side in FIG. 3 is referred to as a front regulation member 35F, the member positioned on the left side is referred to as a rear regulation member 35R, and simply the side edge regulation members 35 refer to both of the left and right members.

The side edge regulation members 35 are supported by the apparatus frame (processing tray bottom portion or the like) to be able to shift to positions in the direction orthogonal to the sheet carry-in direction on the processing tray, and are respectively provided with front-side shift device 40F and rear-side shift device 40R. Although a specific configuration of the shift device 40 will be described later, the side edge regulation members 35 are coupled to drive motors (shift motors SM1, SM2 described later), and align the width of the sheet that is carried onto the processing tray by operation ("alignment operation" described later) for approaching and separating the engagement surfaces 35F, which engage in the sheet side edges, in the sheet width direction (lateral direction in FIG. 3) by forward and backward rotation of the motors. By this alignment operation, the sheet of a different side is aligned in the center reference, and the posture of the sheet which is carried in the support surfaces 35*x* while being skewed or registered is corrected along the reference line.

The present invention is characterized in that a controller 55 described later controls the shift device 40 to cause the side edge regulation members 35 to execute the "alignment operation" and "carry operation".

[Alignment Operation]

The right and left side edge regulation members 35F, 35R are shifted from waiting positions Wp to alignment positions Ap when a sheet is carried in the processing tray 24, and align the sheet in a correct position. As shown in FIG. 3, the sheet is carried from the transport path 22 to the processing tray 24 in the center reference. When this sheet is carried having a different size, and skewed registered posture, the right and left side edge regulation members 35F, 35R are position-shifted from the waiting positions Wp to the alignment positions Ap. By this operation, the sheet is positioned in a correct position in a correct posture in the center reference.

The controller 55 described later detects passage of the sheet in the transport path 22 (in the means shown in the figure, with a sheet discharge sensor Se1), and after a predicted time the sheet arrives at the sheet end regulation stopper 28, shifts the positions of the right and left side edge regulation members 35F, 35R from the waiting positions Wp to the alignment positions Ap.

Therefore, the side edge regulation members 35 are disposed to be able to shift to positions in the sheet width direction along slit grooves 24*x* formed in the support surface 24*a* of the processing tray, and are coupled to the shift device 40 (rack-pinion mechanism described later) disposed on the tray back (bottom) side. Then, a position sensor (not shown) is disposed in a home position Hp, and each of the side edge regulation members 35F, 35R is configured to reciprocate between the waiting position Wp and the alignment position Ap corresponding to the sheet size by a rotation amount of the shift motor SM1 (SM2) described later, respectively.

In FIG. 3, for the side edge regulation member 35, the alignment position Ap is shown by the solid line, the waiting position Wp is shown by the dashed line, and the home position Hp is shown by the chain line. Then, the waiting position Wp is set at a position (Aj) away outward from the alignment position Ap set in the position in the center reference for each sheet size, and is set at a value larger than a reference which is a maximum position deviation amount of the sheet to carry in. Accordingly, when the members reciprocate from the waiting positions Wp by a predetermined stroke, it is possible to align all sheets carried onto the processing tray in a correct position.

[Carry Operation]

There are a case of performing post-processing on sheets (bunch), which are aligned on the processing tray, in the alignment position, and another case of shifting the position to a position (for example, processing position; the same in the following description) different from the alignment position to perform post-processing. In the apparatus shown in the figure, in the case of the "binding processing mode", the stapler apparatus 26 performs the binding processing in the alignment position Aj when the first binding processing device is selected, and when the second binding processing device is selected, after shifting the sheet bunch to the processing position Ep different from the alignment position Aj, the press binder apparatus 27 performs the binding processing.

As shown in FIG. 3 (at the time of execution of the second binding processing device 27; the same in the following description), it is necessary to shift the position of the sheets in a bunch state (including the sheet alone) for a section of a distance St between the alignment position Aj and the processing position Ep. Further, in the case of a "jog sorting mode", there is processing for carrying out a bunch of collated sheets to the stack tray 25 on the downstream side after aligning the sheet, which is carried in the processing tray 24 from the transport path 22, in a first position (for example, Hp position shown in the figure), and processing for carrying out the bunch of sheets to the stack tray 25 on the downstream side after aligning in a second position (for example, Apposition shown in the figure) different from the first position. Thus, there is the case of shifting the position of a bunch of sheets collected on the support surface to the different position, and there are a fear that the posture of the aligned sheets becomes distorted during the shift process, and another fear that the shift load increases.

Therefore, the present invention is characterized by causing the right and left side edge regulation members 35F, 35R to execute the "carry operation" in shifting the position of sheets aligned on the support surface to a predetermined position (for example, processing position). When the sheets (bunch) are shifted along the support surface 24*a* by the shift distance ST shown in FIG. 3, "the right and left side edge regulation members 35 are shifted to positions in the same direction at the same time", while the side regulation members 35 shift "a shift span St1 to carry in a state in which the sheets are curved and a shift span St2 to correct curving of the sheets (without curving or deforming the sheets)".

Figure 4A:
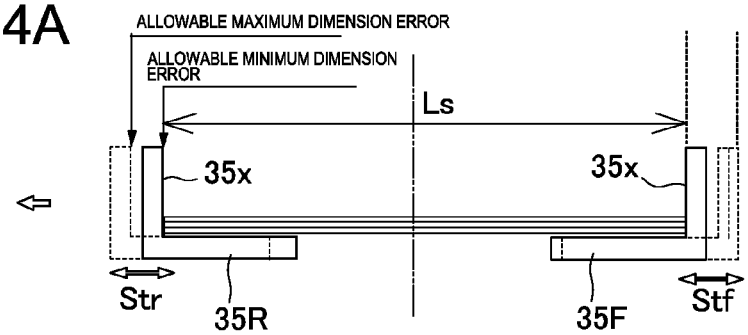
FIGS. 4A-4E show configuration explanatory views of sheet side edge regulation members and shift device thereof in the mechanism of FIG. 3, where
Figure 4B:
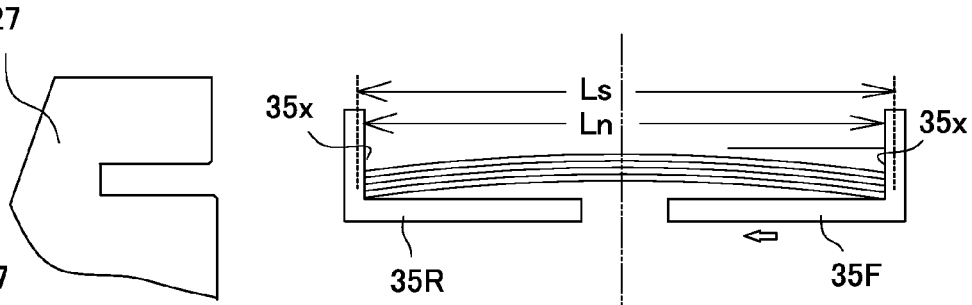
Figure 4C:
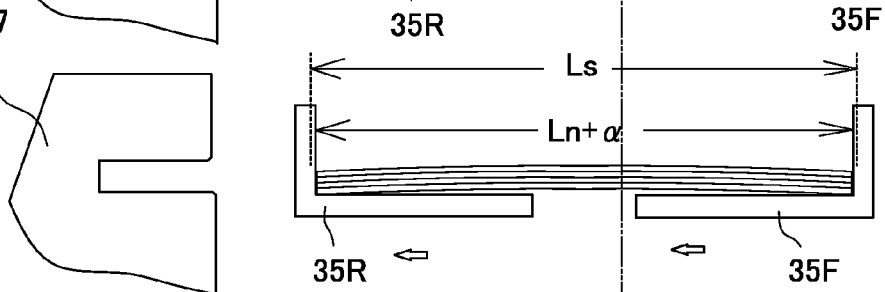

Accordingly, when the description is given according to FIGS. 4A-4E, FIG. 4A shows a state in which sheets are aligned in the alignment position Ap on the support surface by the alignment operation. At this point, the sheets are neither curved nor deformed, and are supported on the support surface. FIG. 4B shows a state in which the side edge regulation members 35 have position-shifted the shift span St1, and the sheets are curved and deformed in the shape of a U or in the shape of an inverted U. FIG. 4C shows a state in which the side edge regulation members 35 are position-shifting the shift span St2, and the sheets are curved and deformed in the shape of a U or in the shape of an inverted U, but the curvature is decreased (the curving degree is deformed in a gentle curve).

Figure 4D:
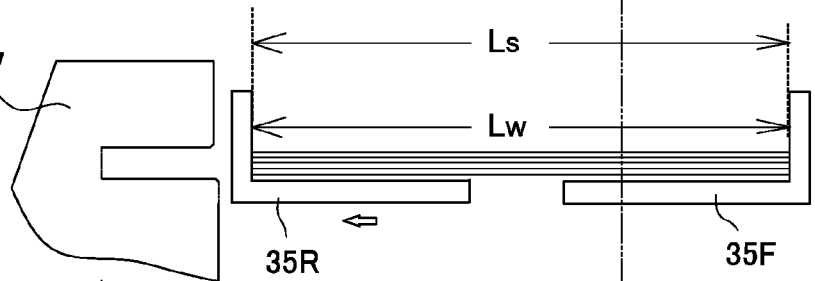
Figure 4E:
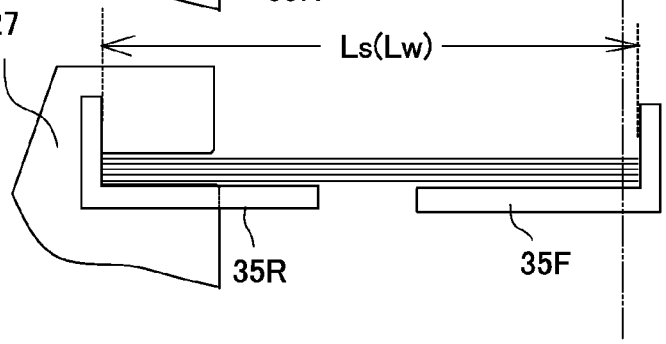

FIG. 4D shows a state in which the side edge regulation members 35 position-shift the shift span St2 which is a state immediately before the shift of the sheets is finished. At this point, the sheets are returned to the state in which the sheets are neither curved nor deformed. Then, FIG. 4E shows a state in which the sheets shift to the predetermined processing position, and are halted.

Thus, by shifting to the predetermined shift position (processing position) by the shift span St1 for curving and deforming the sheets and the shift span St2 for correcting curving and deformation, in the span St1, transport friction between the sheets and the support surface 24*a* and transport friction between the sheets and the uppermost sheet on the stack tray is reduced as compared with the case of being transported in a flat state.

Further, in the span St1, since the sheets shift while being curved and deformed by the right and left side edge regulation members 35F, 35R, there is no fear that the sheets are skewed. Concurrently, in the sheets in a strengthened state, there is no fear that the sheets easily cause bending such as skew even when undergoing action of force or vibration from the outside (for example, from a subsequent sheet).

Furthermore, in the sheets carried to the predetermined processing position, there is no fear that the sheets do smoothly not enter the post-processing mechanism or the like in the curved and deformed state, and that the sheets cause a displacement by rebound when curving is corrected in the post-processing position (when regulation of the side edge regulation members 35 is released).

For the curving deformation of the sheets in the above-mentioned shift span St1, the distance between a pair of side edge regulation members 35G, 35R is changed to be narrower (Ln) than the distance (Ls) in the alignment operation to make a state in which pressure is applied to the sheets, and the sheets are thereby curved and deformed to shift to positions. Further, for the deformation correction of the sheets in the above-mentioned shift span St2, the shift device 40F, 40R on the front side and rear side are controlled so as to return the distance between a pair of side edge regulation members 35F, 35R from the narrow distance (Ln) to a wide distance (Lw) before the shift is finished.

It is possible to execute such control of the shift device 40 by the following Embodiment 1, Embodiment 2 or Embodiment 3. Embodiment 1 is the case of varying shift timings of the right and left side edge regulation members 35F, 35R, Embodiment 2 is the case of varying shift velocities of the right and left side edge regulation members 35F, 35R, and Embodiment 3 is the case of varying shift directions of the right and left side edge regulation members 35F, 35R. Each of the Embodiments will be described below.

In addition, the apparatus shown in the figure illustrates the case of shifting a bunch of sheets from the alignment position (support surface center portion) to the second binding processing device 27 (press binder apparatus) disposed on the apparatus rear side by the predetermined distance ST. Accordingly, the rear regulation member 35R is positioned at the front in the shift direction, and the front regulation member 35F is positioned at the rear in the shift direction. When the binding processing device is disposed on the apparatus front side, or in jog sorting, also in the opposite direction i.e. in an aspect for shifting the sheets from the apparatus rear side to the apparatus front side, it is possible to understand as in the following description (control the right and left side edge regulation members 35F, 35R symmetrically).

Embodiment 1

Figure 5A:
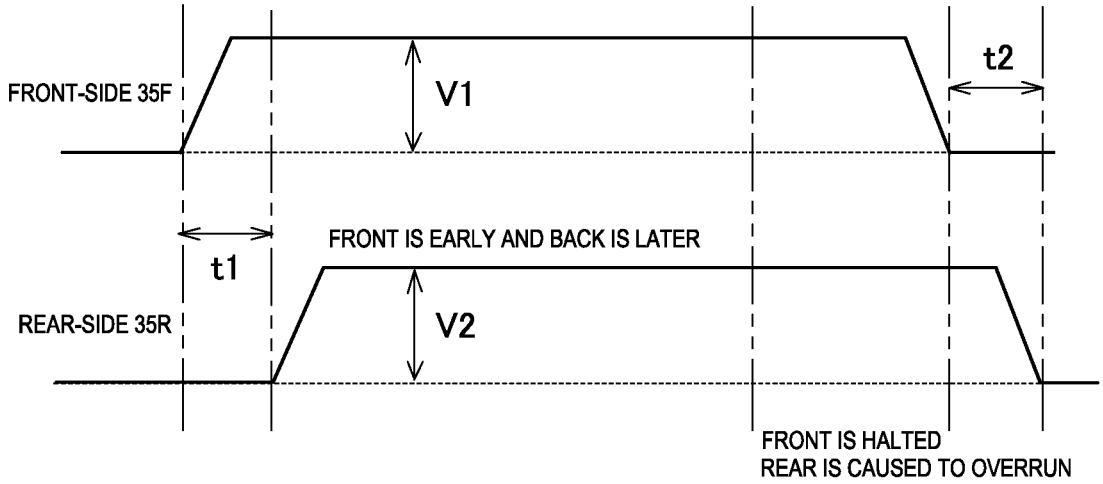
FIGS. 5A-5C contain velocity line diagrams in alignment operation and sheet carry operation of the sheet side edge regulation members in the mechanism of FIG. 3, where

The description will be given according to FIG. 5A. The front regulation member 35F (rear side in the shift direction) is first shifted from the alignment position toward the processing position. After a lapse of predetermined time (t1), the rear regulation member 35R (front side in the shift direction) is shifted. Then, the sheets are curved and deformed in the state of FIG. 4B. Next, during a period of shifting the span St1, the front regulation member 35F and the rear regulation member 35R are respectively shifted at a velocity V1 and at a velocity V2 in the same direction. At this point, when the velocity V1 and velocity V2 are set at the same velocity, the sheets shift with almost the same curving degree, and when the velocities are varied, shift while the curving degree (curvature) increases, or decreases.

Then, at the span St2, the front regulation member 35F is first halted, and the rear regulation member 35R is decelerated and halted while delaying by predetermined time (t2). At this point, both of the regulation members 35F, 35R are halted in the predetermined processing positions. Then, the curving degree of the sheets is reduced in the state of FIG. 4C, and the sheets become the flat posture without curving or deforming in the state of FIG. 4D, and next, are positioned in the processing position in the state of FIG. 4E.

Embodiment 2

Figure 5B:
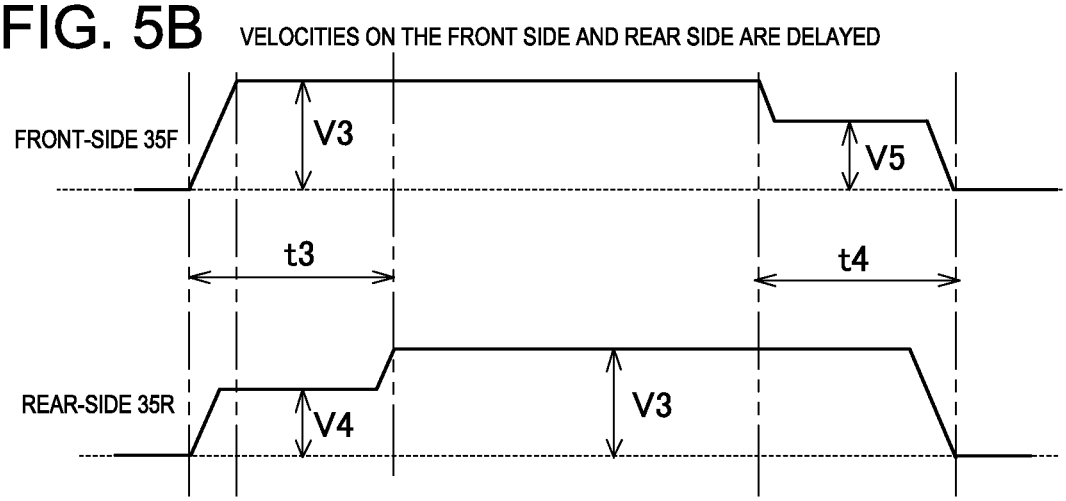

The description will be given according to FIG. 5B. The right and left side edge regulation members 35F, 35R are started to shift at the same time from the alignment positions toward the processing positions. At this point, the front regulation member 35F (rear side in the shift direction) is shifted at a high velocity (velocity V3), and the rear regulation member 35R (front side in the shift direction) is shifted at a low velocity (velocity V4) (V3>V4). Then, the sheets are curved and deformed in the state of FIG. 4B. After a lapse of predetermined time (t3), the front regulation member 35F and the rear regulation member 35R are respectively shifted at the velocity V3 and at the velocity V4 in the same direction.

During a period of shifting the span St1, the velocity V3 and the velocity V4 are set at the same velocity (for example, velocity V3). Then, during the period of shifting the span St1, the sheets are maintained in the curving deformed state. Next, in the span S2, the front regulation member 35R is first decelerated from the velocity V3 to a velocity V5 (V3>V5). Then, the curving degree of the sheets is reduced in the state of FIG. 4C, and the sheets are deformed to the flat posture without curving or deforming in the state of FIG. 4D. Next, after a lapse of predetermined time (t4), both of the regulation members 35F, 35R are halted. Then, the sheets are positioned in the processing position in the state of FIG. 4E.

Embodiment 3

Figure 5C:
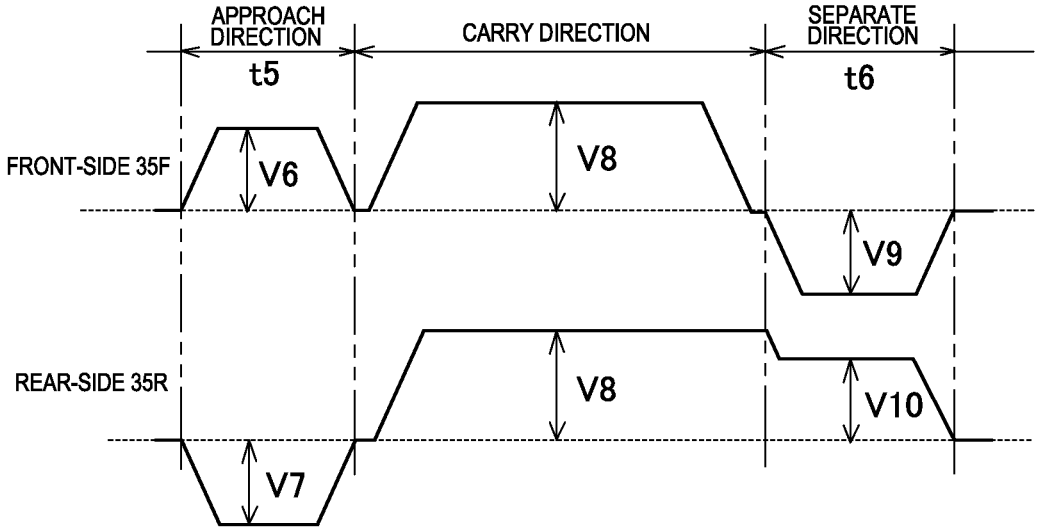

The description will be given according to FIG. 5C. This Embodiment is the case of shifting the right and left regulation members 35F, 35R in approach directions (mutually opposite directions) in curving sheets in the shape of a loop, and in canceling the loop of the sheets, shifting the right and left regulation members 35F, 35R in separate directions, while further shifting backward the regulation member 35R on the rear side in the shift direction.

The controller 55 starts to shift the right and left side edge regulation members 35F, 35R at the same time. At this point, the front regulation member 35F shifts to the processing position side at a velocity V6, and the rear regulation member 35R shifts at a velocity V7 in a direction opposite to the shift direction. Then, the right and left regulation members 35F, 35R mutually approach to form curving in the shape of a loop in the sheets. Next, during a period of shifting the span St1, the right and left regulation members 35F, 35R shift at the same velocity V8 in the shift direction. Then, the sheets shift in a state in which curving is held in the state of FIG. 4B.

Then, in the span St2, the means 55 halts the front regulation member 35F to shift backward at a velocity V9 in the direction opposite to the shift direction, and decelerates the rear regulation member 35R to shift at a velocity V10 in the shift direction. Then, the curving degree of the sheets is reduced in the state of FIG. 4C, and the sheets are changed to the posture without curving or deforming in the state of FIG. 4D. Next, after a lapse of predetermined time (t6), the means 55 halts both of the regulation members 35F, 35R to position the sheets in the processing position in the state of FIG. 4E.

The structure of the side edge regulation members 35 described previously according to FIGS. 4A-4E will be described. A pair of right and left side edge regulation members 35F, 35R are the same in the right and left structures except an adjuster spring 45 described later, and therefore, one of the members will be described. The side edge regulation member 35 is comprised of a plate-shaped member having a plane-shaped engagement surface 35*x* to come into contact with the side edge of sheets (side end surface of a bunch of the sheets). One portion (base end portion) of this regulation member is supported slidably by a guide member 44 (guide rod in the member shown in the figure) disposed in the apparatus frame, the guide member is disposed in the sheet width direction, and the side edge regulation member 35 is configured to be able to shift to positions in the sheet width direction along the guide member 44.

In a pair of right and left side edge regulation members 35F, 35R as described above, the engagement surface 35*x* of at least one of the members is configured to be movable in the sheet width direction (transport orthogonal direction) with the elastic member 45 (adjuster spring) so as to be able to elastically shift. This is because of enabling, since an allowable error is set on dimensions of sheets, one of the left and right engagement surfaces to be elastic so as to properly engage in sheets with different lengths within an allowable error range (for example, ±2 mm).

Figure 6A:
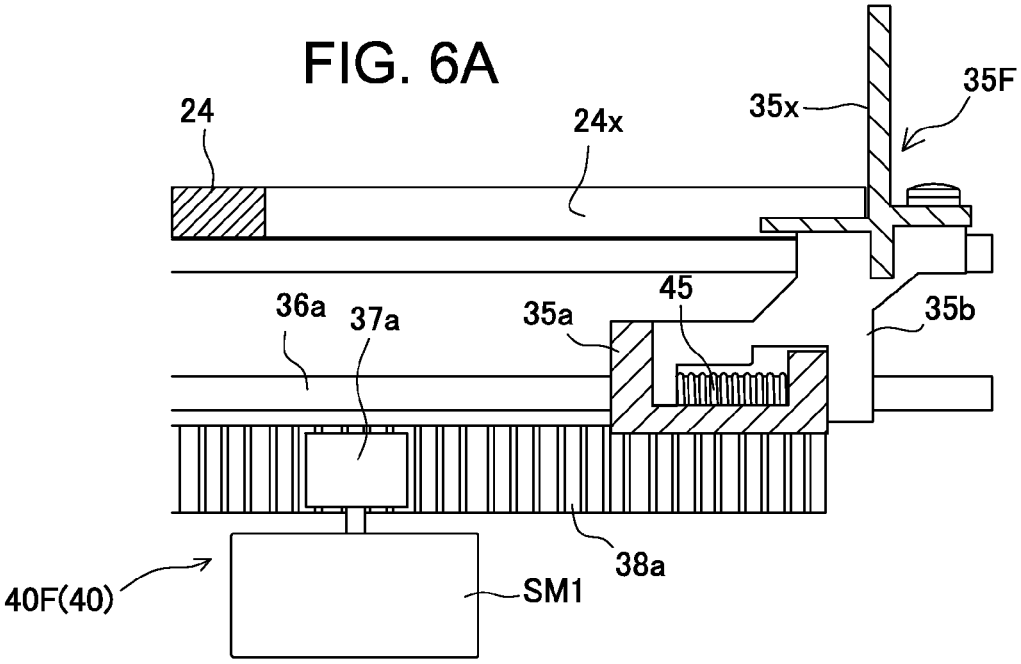
FIGS. 6A-6D contain explanatory views of the side edge regulation members in the apparatus of FIG. 1, where

As shown in FIG. 6A, the side edge regulation member 35F on the front side is fitted into a first guide rod 36*a* slidably, and is coupled to the first shift device 40F via the elastic member 45 (adjuster spring). This side edge regulation member 35F is comprised of a base end slide portion 35*a* and a movable engagement portion 35*b*. The movable engagement portion 35*b* is fitted into the first guide rod 36*a* slidably, and is provided with the engagement surface 35*x* that engages in the sheet side edge on the support surface (paper mount surface) 24*a*. The base end slide portion 35*a* is fitted into the first guide rod 36*a* slidably, and is coupled to the drive motor SM1 (first shift motor).

The base end slide portion 35*a* and movable engagement portion 35*b* are coupled via the elastic member 45 wound around the first guide rod 36*a*, and a drive force of the drive motor SM1 transferred to the base end slide portion 35*a* is transferred to the movable engagement portion 35*b* via the elastic member 45 (adjuster spring).

Figure 6B:
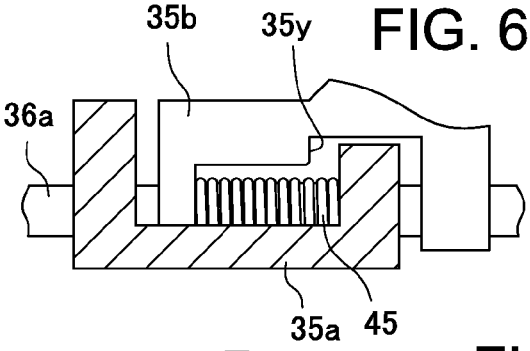
Figure 6C:
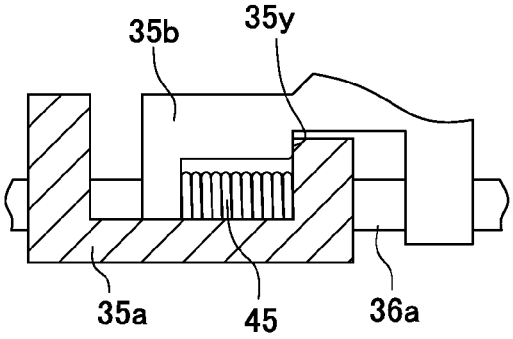
Figure 6D:
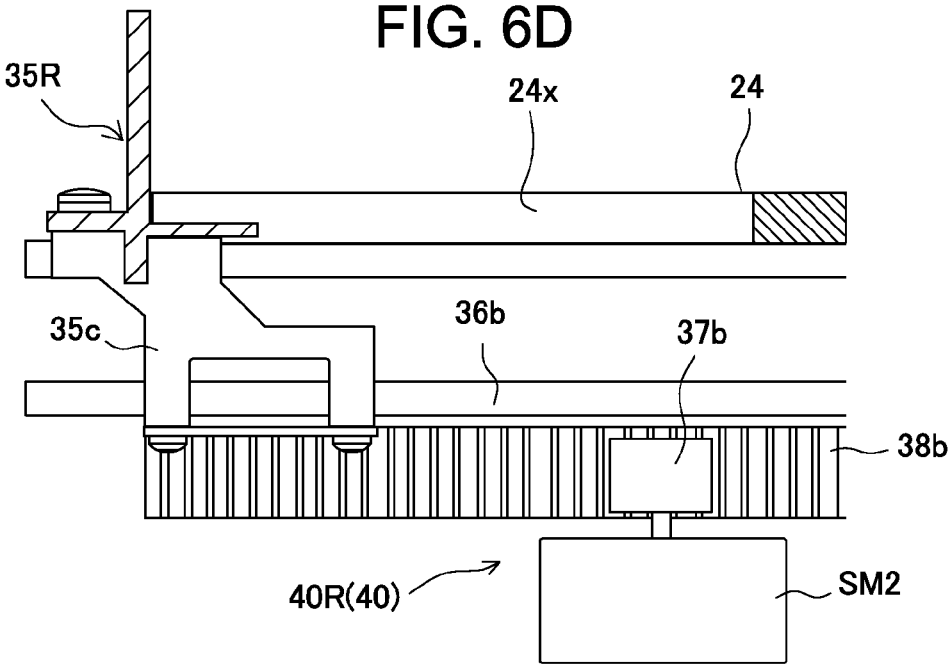

As shown in FIG. 6D, the side edge regulation member 35R on the rear side is fitted into a second guide rod 36*b* slidably, and is coupled to the second shift device 40R. This side edge regulation member 35R is integrally formed in a base end slide portion 35*c*. Then, the base end slide portion 35*c* is fitted into the second guide rod 36*b* slidably, and is coupled to the drive motor (second shift motor) SM2.

Each of the first and second shift motors SM1, SM2 is comprised of a stepping motor capable of rotating forward and backward, a rotating shaft of each of the motors is coupled to a transmission pinion 37*a* or 37*b*, and a rack 38*a* or 38*b* meshing with the pinion is integrally formed in each base end slide portion 35*a* or 35*c*, respectively. Further, in each base end slide portion 35*a* or 35*c*, a position sensor Se2 or Se3 is disposed in the home position, respectively.

The elastic member 45 as described above is comprised of a spring (coil spring, plate spring or the like) to add an elastic force, elastic member (sponge, elastomer or the like), and biasing member (weight or the like) so as to enable the engagement surface 35*x* of at least one of a pair of right and left side edge regulation members 35F, 35R to be elastically movable. Then, the elastic member 45 elastically adjusts an engagement force that the paper mount surface 24*a* engages in the sheet side edge in between the portion and the movable engagement portion 35*b* separated from the base end slide portion 35*a* coupled to the shift device 40.

In other words, the elastic member 45 (adjuster spring) is adjusted (designed in spring) so as to add a force that the engagement surface 35*x* reliably comes into contact with the sheet side edge, and an addition force to reduce the force to such an extent that the sheet is neither distorted nor deformed. Then, the elastic force (hereinafter, this force is referred to as an "alignment force") is adjusted so that the engagement surface 35*x* engages in the sheet side edge to correct the position (posture) without forcibly distorting or deforming the sheet even when the sheet length varies within a dimension error (for example, ±2 mm).

A locking stopper 35*y* in FIG. 6A is a stopper that locks the movable engagement portion 35*b* when a force higher than the force (alignment force) to align the sheet property is applied to the base end slide portion 35*a* from the shift motor SM1, and in a state of being locked in this stopper, the movable engagement portion 35*b* is inelastic, while the engagement surface is immovable.

In addition, the apparatus shown in the figure illustrates the case where the adjuster spring is disposed in the engagement surface on the apparatus front side, and the adjuster spring may be disposed in the engagement surface on the apparatus rear side, or adjuster springs may be disposed in both of the right and left engagement surfaces. Further, in executing the "alignment operation" that both side edge regulation members 35F, 35R align the sheet, the apparatus shown in the figure makes at least one of the engagement surfaces elastically movable (state of FIG. 6B), while in executing the "carry operation" that both side edge regulation members 35F, 35R shift the sheet from the alignment position to the processing position, making both of the engagement surfaces inelastically immovable states (state of FIG. 6C).

In addition, the Embodiments as described above illustrate the case where the second binding device 27 that performs the binding processing on a bunch of sheets is disposed on the apparatus rear side, and the sheets aligned in the center portion of the support surface 24*a* are offset-shifted to the apparatus rear side, and it is also naturally possible to offset-shift the sheets aligned in the alignment position to the apparatus front side. Further, the case is described where the sheets are positioned in the processing position with the side edge regulation members 35, and a stopper member different from the regulation member may be disposed in the processing position (shift position) so that the sheet end edge strikes the stopper member to be positioned. In this case, the rear-side regulation member 35R may be caused to overrun from the shift position.

[Control Configuration]

Figure 7:
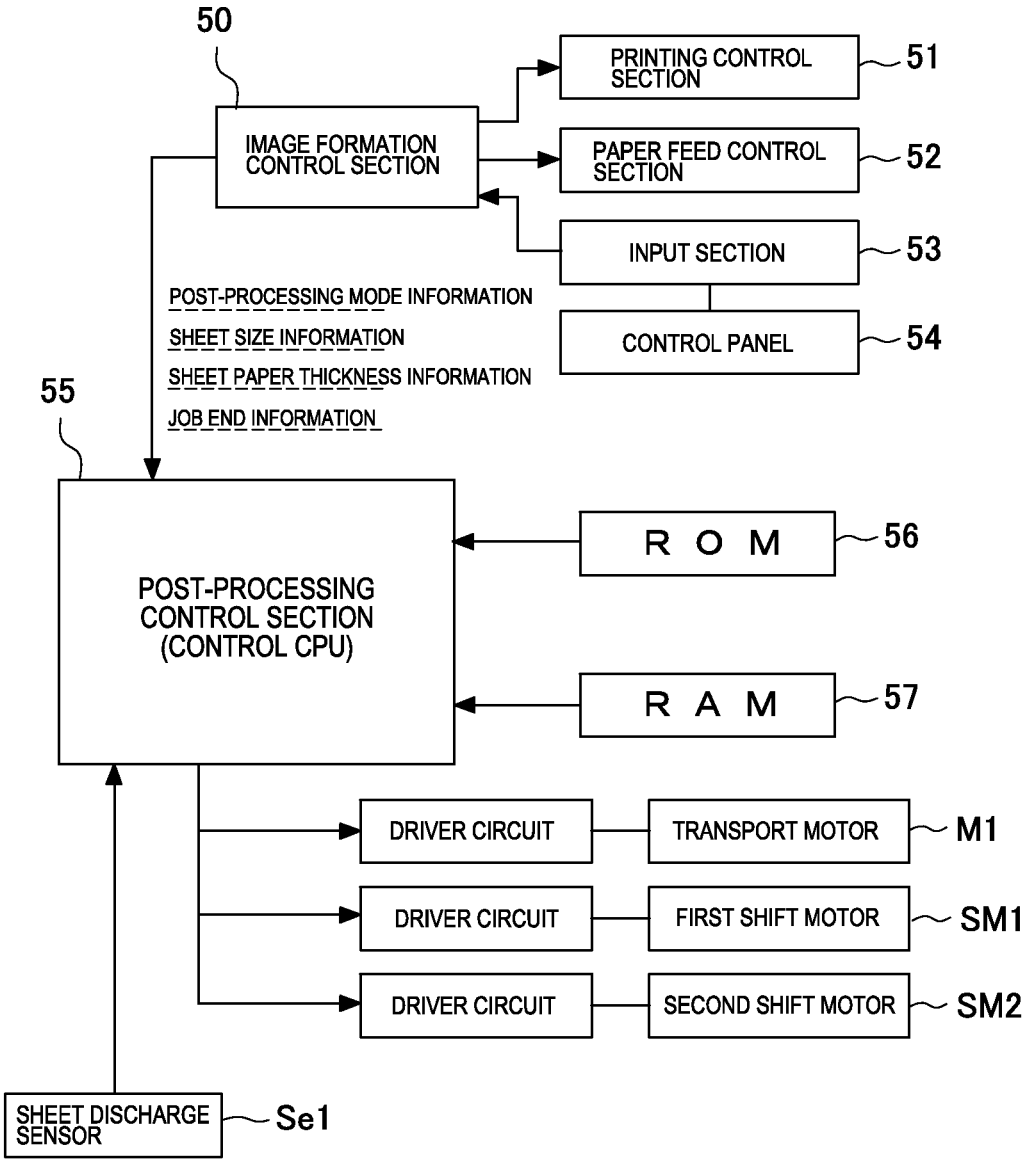
FIG. 7 is a block diagram illustrating a control configuration in the apparatus of FIG. 1.

Control of the apparatus in FIG. 1 will be described next according to FIG. 7. The controller 50 on the image formation apparatus side is a control CPU, and is provided with a printing control section 51, paper feed control section 52, and input section 53. The input section 53 is provided with a control panel 54 to which an operator inputs image formation conditions and post-processing condition. The image formation control section 50 transfers post-processing mode information selected by the operator, sheet size information, sheet paper thickness information, job end signal and the like to the post-processing control section 55.

The post-processing control section 55 is incorporated into the post-processing apparatus B, and is configured to execute the post-processing based on the information sent from the image formation apparatus A. Then, the post-processing control section 55 is configured to execute post-processing operation with a program stored in ROM 56 based on data stored in RAM 57.

Therefore, to the post-processing control section 55 are transferred a detection signal of the sheet discharge sensor Se1 of the transport path 22, an operation end signal of the binding device 26 (27) and the like. Further, the post-processing control section 55 is configured to control a transport motor Ml that drives a transport roller disposed in the transport path 22, the first shift motor SM1, the second shift motor SM2, and the like.

[Operation State Explanation]

Figure 8:
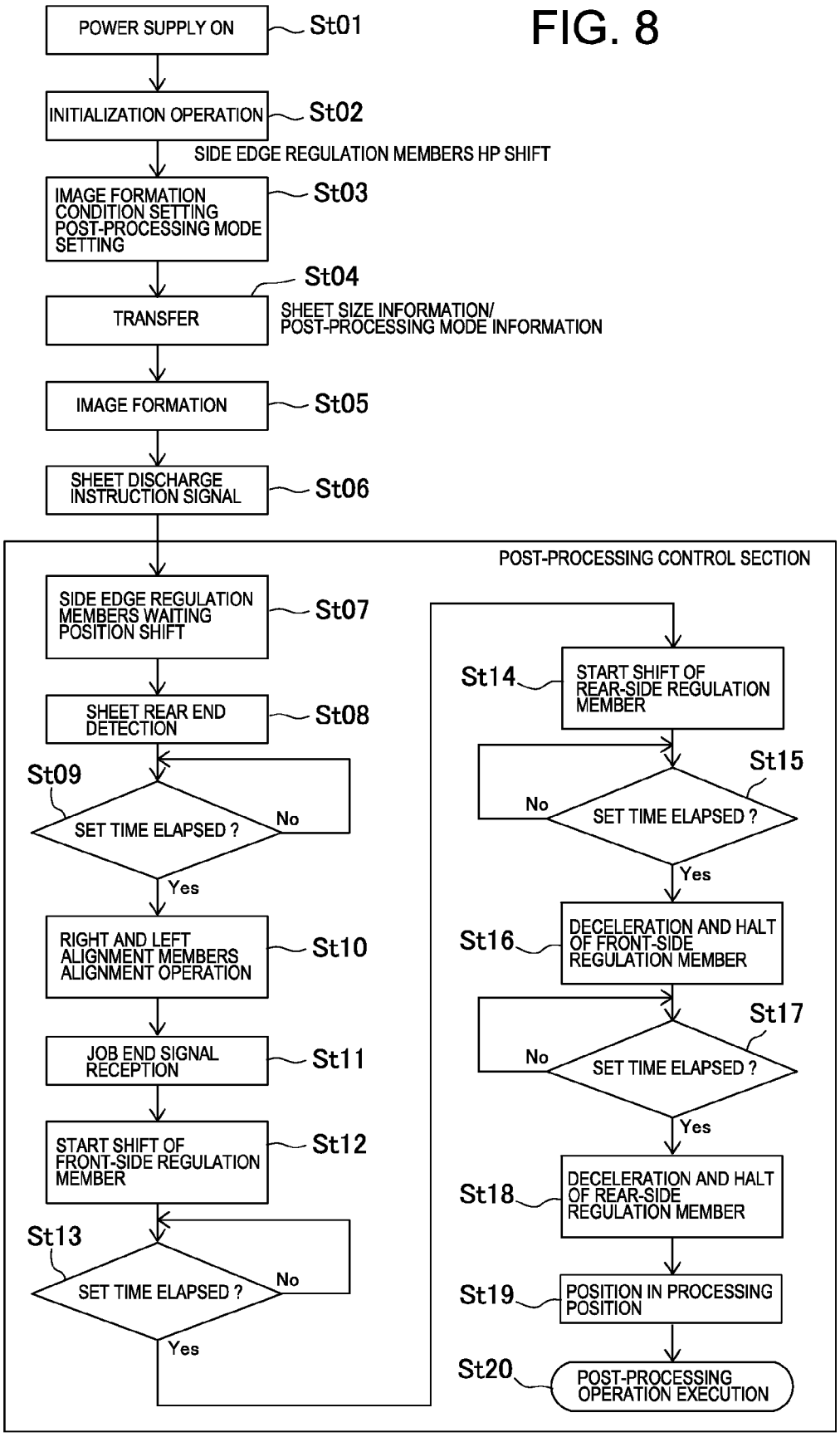
FIG. 8 is a post-processing operation flow diagram in the apparatus of FIG. 1.

Matters of the post-processing operation will be described according to a flowchart as shown in FIG. 8. In addition, the flowchart in the figure illustrates an operation state of Embodiment 1 as described previously, and in relation thereto, this Embodiment will be described. When apparatus power supply is turned on (St01), initialization operation is executed (St02). By this operation, the side edge regulation members 35 are positioned in home positions. Setting of image formation conditions and setting of a post-processing mode is performed in the control panel 54 of the input section 51 of the image formation apparatus A (St03). By this setting are set a sheet size to form an image, image formation conditions, and post-processing (finish processing) condition of the image-formed sheet.

Next, when the image formation conditions and post-processing condition are set, the image formation apparatus A transfers the sheet size information and post-processing mode information to the post-processing apparatus B (St04). Concurrently therewith, the image formation apparatus A executes image formation operation (St05), transmits a sheet discharge instruction signal to the post-processing apparatus B, and carries out the sheet to the sheet discharge outlet 16 thereof (St06).

Upon receiving the sheet discharge instruction signal from the image formation apparatus A, the post-processing apparatus B shifts positions of the side edge regulation members 35 to waiting positions set for each sheet size (St07). Then, when the sheet discharge sensor Se1 detects the sheet rear end (St08), the apparatus B actuates a timer, and waits for a lapse of beforehand set time (St09). This time is set at a predicted time the sheet rear end passes through the sheet discharge sensor Se1 and arrives at the sheet end regulation stopper 28.

Then, after a lapse of the set time, the controller 55 causes the side edge regulation members 35 to execute the alignment operation (St10). The alignment operation is to shift the right and left side edge regulation members 35F, 35R from the waiting positions Wp to the alignment positions Ap at the same time. In this operation, a sheet, which is carried onto the support surface, is positioned in a predetermined reference position. This alignment operation is executed whenever a sheet is carried out of the image formation apparatus A, and is finished when a job end signal of image formation is transmitted from the image formation apparatus A (St11).

Upon receiving a job end signal from the image formation apparatus A, the controller 55 of the post-processing apparatus B starts to shift the front regulation member 35F in a carry direction (in the apparatus shown in the figure, eco-binding position direction) of a bunch of sheets (St12). This velocity is beforehand set, and after a lapse of beforehand set setting time t1, curving in the shape of a loop is formed in the sheets.

Next, after a lapse of the setting time t1 (St13), the controller 55 starts to shift the rear-side regulation member 35R in the carry direction (St14). Then, the front regulation member 35F and rear-side regulation member 35R shift toward the carry direction of the sheets at the same velocity together or at individually set velocities. At this point, the sheets shift from the alignment position toward the processing position while being curved in the shape of a loop.

The controller 55 shifts the right and left regulation members 35F, 35R toward the carry direction for predetermined time, and when the time is finished (St15), decelerates and halts the front regulation member 35F (St16). After a lapse of beforehand set time t2 since the deceleration halt of the front regulation member 35F (St17), the controller 55 halts the rear-side regulation member 35R while decelerating (St18). This deceleration halt position of the rear-side regulation member 35R is set at the processing position. Accordingly, after the state in which the bunch of sheets is curved in the shape of a loop is changed to a state (flat shape) in which the curved portion is canceled, the end edge is positioned in the processing position (St19).

By the above-mentioned operation is finished sheet carry-in onto the support surface of the processing tray 24, the alignment operation of the posture, and the position shift of a bunch of collected sheets from the alignment position to the processing position (St20). Then, the controller 55 issues an instruction signal for executing post-processing operation to the post-processing device 27 (in the apparatus shown in the figure, second binding processing device).

The invention claimed is:

1. A post-processing apparatus comprising:

a sheet support portion configured to place a sheet;

a pair of side edge regulation members that engages opposite side edges of a sheet on the the sheet support portion; and a controller that controls to change a distance between the pair of side edge regulation members, wherein the controller controls the pair of side edge regulation members to execute a carry operation of the sheet on the sheet support portion toward a carry direction in a state in which pressure is applied to opposite side edges of the sheet according to a length between the opposite side edges of the sheet.

2. The post-processing apparatus according to claim 1, further comprising an elastic member that is provided in at least one of the pair of side edge regulation members, to add elasticity to an engagement surface that contacts a side edge of a sheet on the sheet support portion to make the engagement surface elastically movable in executing alignment operation, and to make the engagement surface inelastically immovable in executing the carry operation.

3. The post-processing apparatus according to claim 1, further comprising a transport path that transports the sheet, wherein the controller controls the pair of side edge regulation members to align the sheet fed from the transport path in a predetermined reference position, next to shift the sheet to a predetermined processing position, and then, to perform realignment.

4. The post-processing apparatus according to claim 1, further comprising a stopper configured to regulate a position of the sheet carried by the pair of side edge regulation members.

5. An image formation apparatus comprising:

an image formation section that forms an image on a sheet; and a post-processing section that performs post-processing on the sheet fed from the image formation section, wherein the post-processing section is comprised of the post-processing apparatus according to claim 1.

6. The post-processing apparatus according to claim 1, wherein the controller controls the pair of side edge regulation members to apply less pressure on the opposite side edges of the sheet after the sheet on the sheet support portion is in a state in which pressure is applied to the opposite side edges of the sheet.

7. The post-processing apparatus according to claim 1, wherein the pair of side edge regulation members comprises a first regulation member and a second regulation member positioned downstream of the first regulation member in the carry direction of the carry operation, and the controller controls the first regulation member to shift earlier than the second regulation member.

8. The post-processing apparatus according to claim 1, wherein the pair of side edge regulation members comprises a first regulation member and a second regulation member positioned downstream of the first regulation member in the carry direction of the carry operation, and the controller controls the first regulation member to shift faster than the second regulation member.

9. A post-processing apparatus comprising:

a sheet support portion configured to place a sheet;

a pair of side edge regulation members that engages opposite side edges of a sheet on the sheet support portion;

a shift device that shifts a position of each of the side edge regulation members, and thereby causing the members to perform carry operation to shift the sheet on the sheet support portion; and a controller that controls the shift device to change a distance between the pair of side edge regulation members, wherein in executing the carry operation, the shift device sandwiches a sheet on the sheet support portion by the pair of side edge regulation members, and thereby makes a state in which pressure is applied to the sheet to execute, and in executing the carry operation, the controller returns the distance between the pair of side edge regulation members to a wide distance by first shifting one of the side edge regulation members positioned at the front in a carry direction to form a narrow distance, and first halting the other one of the side edge regulation members positioned at the rear.

10. A post-processing apparatus comprising:

a sheet support portion configured to place a sheet;

a pair of side edge regulation members that engage opposite side edges of a sheet on the sheet support portion;

a shift device that shifts a position of each of the side edge regulation members, and thereby causing the members to perform carry operation to shift a sheet on the sheet support portion; and a controller that controls the shift device to change a distance between the pair of side edge regulation members, wherein in executing the carry operation, the shift device sandwiches a sheet on the sheet support portion by the pair of side edge regulation members, and thereby makes a state in which pressure is applied to the sheet to execute, and the controller returns the distance between the pair of side edge regulation members to a wide distance after forming a narrow distance using a difference in velocity between one of the side edge regulation members positioned at the front in a carry direction and the other one of the side edge regulation members positioned at the rear.

* * * * *